US005516002A

United States Patent [19]

Morillo

[11] Patent Number: 5,516,002

[45] Date of Patent: May 14, 1996

[54] COIN-OPERATED MACHINE FOR DISPENSING FOODSTUFFS PRESERVED IN FROZEN CONDITION AND READY TO BE SERVED HOT IN SITU

[75] Inventor: Raul V. Morillo, Madrid, Spain

[73] Assignee: Mercury Internacional De Comunicacion, S.A., Madrid, Spain

[21] Appl. No.: 311,011

[22] Filed: Sep. 23, 1994

[51] Int. Cl.[6] ..... G07F 11/00

[52] U.S. Cl. ..... 221/69; 221/150 HC; 221/154; 221/195

[58] Field of Search ..... 221/150 HC, 150 A, 221/2, 7, 8, 69, 103, 110, 191, 194, 195, 154

[56] References Cited

U.S. PATENT DOCUMENTS

| | | | |
|---|---|---|---|
| 3,653,541 | 4/1972 | Crum | 221/150 HC |
| 3,762,601 | 10/1973 | McLaughlin | 221/2 |
| 4,398,651 | 8/1983 | Kumpfer | 221/150 HC |
| 5,121,854 | 6/1992 | Trouteaud et al. | 221/192 |
| 5,209,373 | 5/1993 | Gondek et al. | 221/150 HC |

FOREIGN PATENT DOCUMENTS

| | | | |
|---|---|---|---|
| 0356049 | 2/1990 | European Pat. Off. . | |
| 2663769 | 12/1991 | France . | |
| 3-276389 | 12/1991 | Japan | 221/150 A |
| 3-269798 | 12/1991 | Japan | 221/150 A |
| 3-273388 | 12/1991 | Japan | 221/150 A |
| 93/01569 | 1/1993 | WIPO . | |

*Primary Examiner*—H. Grant Skaggs
*Attorney, Agent, or Firm*—Rogers & Killeen

[57] ABSTRACT

Coin-operated machine for dispensing foodstuffs preserved in frozen condition and ready to be served hot in situ consisting of a casing (2) having a door (3) inside which there is a freezing unit (4) having doors and supporting elements, connected to a compressor unit (6) and a motor (30). The freezing unit (4) has, inside, trays (7) on supporting guides (8) fitted with a multiplurality of hooks (9) acting as electric resistances. On the lower side, there is a hopper (20) connected with the upper entrance of an oven (21) having an upper door (22) and a front door (23). The freezing unit contains the frozen product in a plastic package which has a ring or strip of low density arranged on the hooks (9), the assembly operating from a computer (13) acting on all the mechanisms.

5 Claims, 2 Drawing Sheets

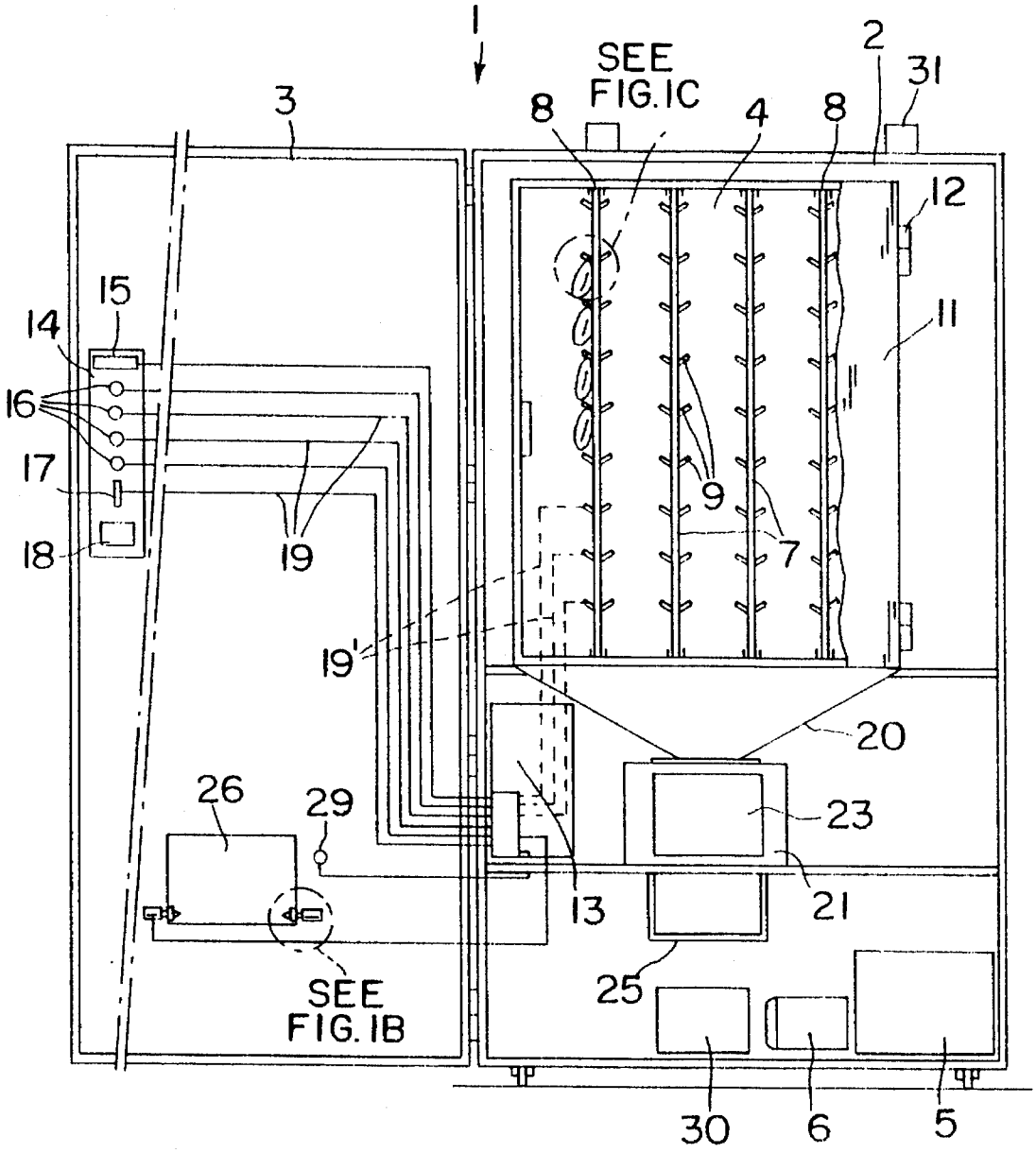
FIG.IA
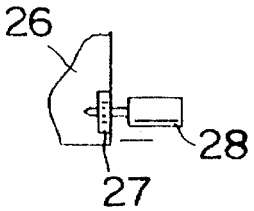
FIG.IB
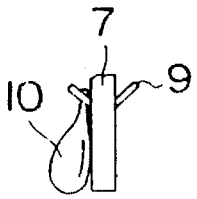
FIG.IC

COIN-OPERATED MACHINE FOR DISPENSING FOODSTUFFS PRESERVED IN FROZEN CONDITION AND READY TO BE SERVED HOT IN SITU

BACKGROUND OF THE INVENTION

This specification refers to a patent of invention relative to a coin-operated machine for dispensing foodstuffs preserved in frozen condition and ready to serve hot in situ, the clear—purpose of which is to constitute a machine able to preserve inside it previously frozen products, preserving them in a frozen condition and, then, when introducing a coin in the machine, to cook the foodstuffs in an oven located inside, and to dispense them already cooked and hot to an user.

FIELD OF THE INVENTION

This invention is applicable to the industry devoted to the manufacture of coin-operated machines, especially coin-operated machines capable of dispensing goodstuffs.

RELATED ART

At present, the existence of many machines is well known, these machines being configurated starting from an outer casing or framework fitted with the corresponding access door, extracting box, and closing devices, which have inside, a series of buckets, guides and pushers to help, in an adequate way, the user to take out a previously chosen product after inserting a coin, this operation allowing the right to operate the machine and the operation of same.

Among the present product dispensers, many types are known which, in general, are operated starting from a series of mechanical elements located inside, there being no need of fitting them with a power feeding, that is to say, to connect them to a source of electrical network, since their mechanisms are fully mechanical.

It is also known the existence of several dispensers performing a dispensing of products contained inside them starting from the operation of them after introducing a coin. These dispensers have internal mechanisms which are not qualified to automatically operate, but they need to be electrically driven, such as, for example, the beverage dispensers.

There are also machines intended for allowing the user to obtain foodstuffs already cooked and preserved by means of a package keeping them under perfect conditions during a previously checked period of time, and operating also after introducing a coin Recently, the applicant is aware of the existence of some—machines which are able to cook in them foodstuffs which are stored inside and that, after the potential consumer's act, choosing the products to be combined, the machine starts through several mechanisms located inside, so carrying out the appropriate cooking thereof, combining the several products contained in the machine the result of which is the potential achievement of a sandwich, such as, for example, a combination of ham and cheese, or ham alone, etc., for which the machine has, inside, a plate to which are incorporated, in gradual steps, the support bread portion, the food configuring the sandwich, and, later, the second portion of bread completing the assembly. The whole is submitted to the operation of a fixed plate and a movable plate acting on the upper side of the food piece to be obtained.

After elapsing a predeterminate period of time, the machine, through a pusher, allows the consumer to take out the food in a hot condition.

In all cases, nevertheless, the foodstuffs dispensing machines known up to date, require the pressing need of being watched in a constant way in order to verify that the product to be dispensed later is perfectly preserved in a good condition, this need being substantially imperative when the food to be dispensed—has an expiring date peculiar to its composition, as it Is obvious when, in the configuration of the food, there are perishable products, such as bread, cheese, ham, pork sausages, and so on.

It is clear that, at present, it would be necessary to have a machine able to carry out the dispensing of a foodstuff able to be perfectly preserved inside it, without requiring the practically constant presence of the men in charge of same in order to effect a vigilance of the food incorporated inside, for which the machine should rely on appropriate means of protection and preservation of the product itself.

Nevertheless, up to date there is no information about the existence of foodstuffs dispensing machines fitted with the features pointed out as suitable.

SUMMARY OF THE INVENTION

The coin-operated machine for dispensing foodstuffs preserserved in frozen condition and ready to be served hot in situ is equipped with a series of own features making it of a great utility, obviating the pressing need, up to now, of watching the product contained inside, maintaining adequately the product incorporated inside, and being able to make ready the frozen product inside it, and dispensing the consumer with the product already cooked and hot, ready to be consumed.

In a more definite way, the coin-operated machine for dispensing foodstuffs preserved in frozen condition and ready to be served hot in situ, is configurated starting from a casing defining the frame thereof, which is fitted with an appropriate door.

Inside the casing, there is arranged a freezing unit driven by a compressor unit which maintains the appropriate temperature and having the relative thermometer which is visualized by a display, which informs automatically about the temperature inside the freezing unit.

The machine has, in an appropriate space, a suitably configured computer to be utilized in the operation of the machine. Said computer is connected, on a side, inside the freezing unit, to the thermometer, to the acting panel of push buttons located above the door, to the product taking out door, to the coin box, to an antivandalic detector, to a static warning device, and, through a telephone line which can be connected to said computer, to a data base, in which the existence of fails in the machine context is detected, and which automatically counts the money received by the machine, as well as the products existing in it, in order to replenish, in a practically constant way the products in case that these would be exhausted due to the consumption of them.

Inside the freezing unit, and located on the upper part, there are a series of guides, which, also, can be used as support, on which there are arranged a series of trays having several side rows of hooks to be used for hanging pouches fitted with a ring which is made of a flexible plastic material of little consistence, these pouches containing the food already cooked in an appropriate manner, and preserved in a frozen condition at several degrees under zero.

On the lower side of the freezing unit, a hopper is direct connected with an entrance existing at the bottom thereof, which is directed towards the upper side of a microwave oven fitted with two doors.

On the upper side of this microwave oven, there is a sliding door to be opened when the product, frozen inside the freezing unit and hung from one of the hooks, is expelled from the freezing unit, falls into the hopper and, in turn, the hopper being directed towards the door of the oven located on the upper side and after being opened the latter, said product contained in the pouch passes within the microwave oven.

Once the computer has detected that the frozen product contained in the pouch has entered the oven, this CPU unit will send the closing element configured as a worn a signal to close the upper door of the oven.

In an automatic way, the product begins to be cooked in the oven, and, after a predetermined time, a front door at the oven will open, and, by means of a pusher, the cooked product will come out from the microwave oven, being deposited on a tray located outside and attached to an entrance formed at the closing door.

Later, it will elapse a prefixed term, during which the product leaving the oven will rest for some instants to allow its temperature to descend.

Then, the computer will show by means of a luminous signal existing outside the door addressed to the consumer that he or she may take out the product, for which the door will be free from some side pins or pushers, and this will be also shown by a lamp illuminating the inside of the resting tray.

The user takes out the product, the door returns to its closing position and the closing pushers act again preventing an inappropriate access inside.

The computer or CPU unit incorporated inside the machine carries out also a selfchecking of the machine in order to verify that the machine is in good order of operation, for which it has the possibility that the display located on the upper side of the push button panel shows the several acting steps of the machine, apart from the fact that this same display can be utilized to inform the user about the existence of possible anomalies, or to suggest to him the guidelines to follow to obtain the desired product.

Lastly, it should be pointed out that the hooks on the vertical trays located inside the freezing unit are able to act as an electric resistance, making it possible that, from a command given by the computerized unit or CPU, the hooks become hot, and as a consequence of this heating, the plastic material tape or strip supporting the package containing the product detaches from its supporting link, drops in the hopper and, then, enters the microwave oven to continue the working process of the whole machine.

BRIEF DESCRIPTION OF THE DRAWINGS

In order to supplement the present specification and to aid to a better understanding of the features of the invention, the accompanying drawings, which form a part of this specification, show in an illustrative but not limitative manner the essence of the present invention, and in which:

FIG. 1 shows a front elevational view of the coin-operated machine for dispensing foodstuffs preserved in frozen condition and ready to be served hot in situ, in which it can be seen the machine with its access door fully open.

DETAILED DESCRIPTION OF THE INVENTION

Figure 2:
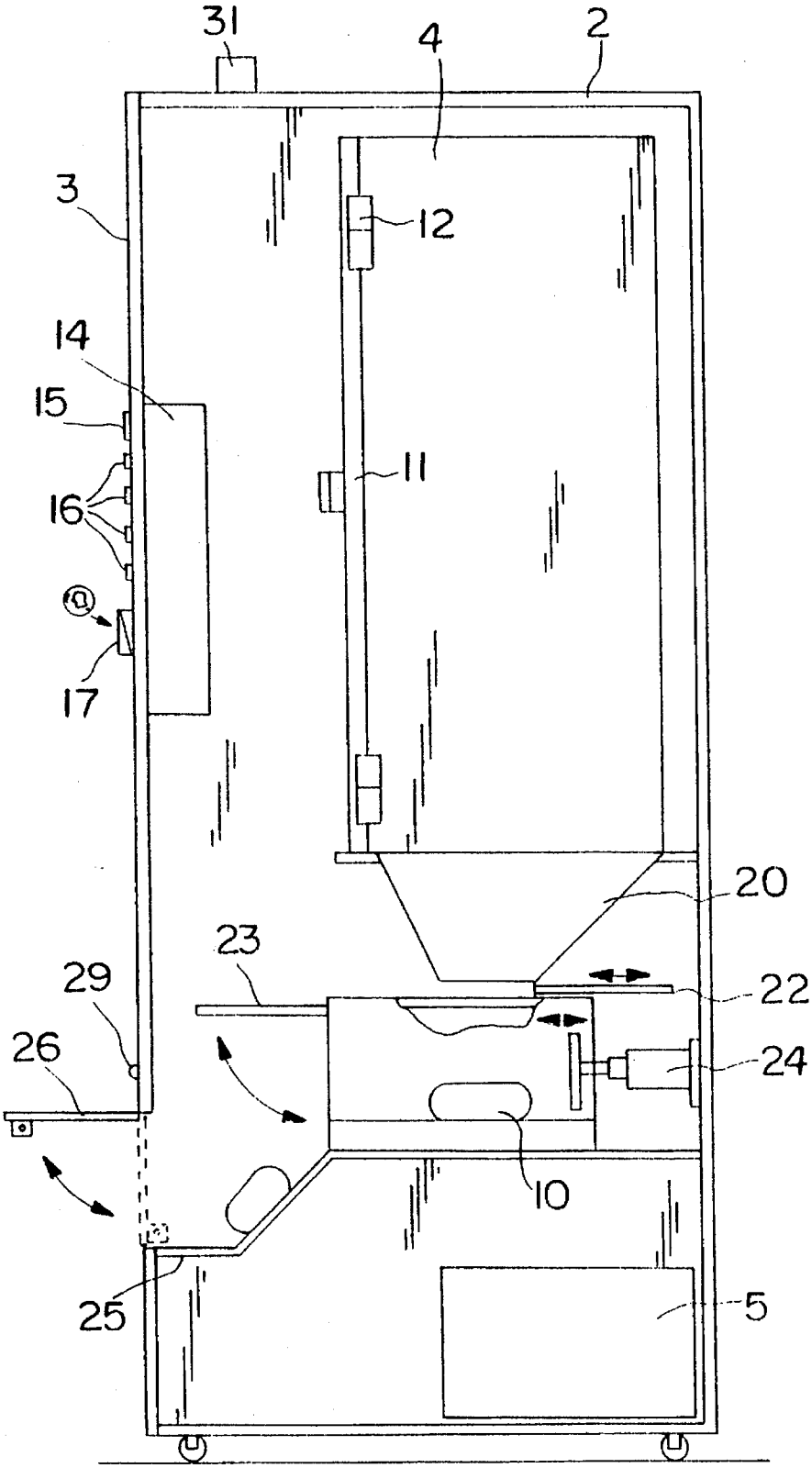
FIG. 2 shows a side elevational view, duly sectioned, of the machine represented on FIG. 1.

In view of these Figures, it can be noted that the foodstuffs dispensing machine 1 is constituted starting from a casing, consisting of a main body 2, fitted with an access door 3 equipped with the relative closing and safety elements.

Inside the body 2, there is a freezing unit 4 with its corresponding door 11, which is fastened, on one of its vertical sides, by hinges 12.

The freezing unit 4 has, in an adjacent zone, a digital thermometer showing the temperature within the unit, and it is fed by a compressor 6 and a motor 30 connected to the freezing unit 4 by means of conventional piping.

Inside the freezing unit 4, there are provided guides 8 fixed to the upper part by conventional means, these guides 8 acting, at the same time, as supports for trays 7 vertically arranged, which are fitted with emerging hooks 9 to act as a supporting element of packages 10 containing the foods to be cooked and in a frozen condition.

The freezing unit 4 is open on its lower side and, fixed to this part, a hopper 20 is located having a lower opening directed to a door which can be opened by means of a worn and—which is located on the upper side of a microwave oven 21.

The microwave oven 21 has a front door 23.

On the front side of the microwave oven 21, and directed towards the oven door 23, there is a receiving tray 25 which can be located fixed on the casing itself 2 or direct fastened to the door 3 and also directed towards a supplementary door 26 allowing to take out the previously frozen product, this latter door 26 being fitted with closing elements 28 having fixing pins 27.

The door 26 has a lamp for advising that the product 29 can be taken out.

Likewise, inside the main casing 2 there is located a CPU computer 13, intended for controlling the operation of the machine as a whole.

On the access door, there are an automatic coin box and a frame 14 in which a push button panel is located, fitted with the appropriate selecting push buttons 16, a display 15, a groove 17 through which coins are introduced, and a device 18 indicating both the operation of the coin box and the machine.

From the computer unit 13, connections 19 emerge, which are connected to the display 15, the push buttons 16, as well as the coin-box indicator 18. Apart from the mentioned connections 19, there are other connections 19' to the trays 7 and other elements existing in the machine.

The foodstuffs dispensing machine can be optionally connected direct with a telephone line connected, in turn, to a central—unit or a control station, where an audit is made, the possible alarms in case of a fraudulent usage of the machine or vandalic destruction are appraised and the products existing In the freezing unit 4 and even the damages or anomalies which could have been caused are checked.

Synthesizing, the foodstuffs dispensing machine operates as follows:

An user wishes to take out a food from it, and after checking that the machine is ready to be used from the signaling shown on the coin-box 18 and display 15, he or she introduce a coin or coins in the machine according to the prefixed amount shown at the push button panel.

Later, he or she will push one of the buttons 16 and the machine, after checking the amount introduced and returning the corresponding change, if any, shows on the display 15 that the process of operation of the machine is beginning for the delivery of the product sought.

The computer is already operating and send commands to the freezing unit, memorizing perfectly which is the product to be dispensed, for which it will send the appropriate commands to—the trays 7 in order that one of the hooks warms up adequately, since said hooks are configurated as electric resistances, so that upon reaching the appropriate temperature, the plastic strip supporting the package containing the product 10 breaks, drops in the hopper 20 and, at the same time, the upper door 22 of the oven 21 opens, the package containing the product 10 drops inside and the food serving cycle starts.

Of course, this cycle Is configurated in consecutive stages of defrosting and cooking at a predeterminate time.

These operations, gradually performed by the machine, are shown on the display 15 and seen by the consumer.

The upper door 22 of oven 21 closes automatically in response to the commands received from the computer 13 by means of a worm not shown.

When the prearranged time for cooking the food has elapsed, the front door 23 of oven 21 opens, and a pusher 24 located in the oven 21 expels the food hot and at a high temperature, and the food is deposited on a tray 25, and the machine lets the user know, at the same time, through the display 15, to wait a moment.

Later, a product removal indicator 29 will turn on, so informing the user he or she can take out the product, for which, and at the same time, the computer will send the appropriate orders to an opening control 28 on the door 26, to release the fixing pins 27 and to permit, therefore, the door 26 to open.

Once the product has been taken out, the door 26 drops, the opening control 28 fixes the pins 27 and the product removal door 26 cannot be opened until repeating again the food serving cycle.

As it is clearly pointed out, the CPU unit is the main element in the machine, and it allows this to manage all the operating stages which are peculiar to the machine, having a connection for optional checking.

When the shortage of products has been detected, the machine will show the nonexistence of the product sought on the display 15. Also, the machine is qualified to send appropriate orders to a station to which is optionally connected by a telephone line, in the sense that the maintenance operator must replenish the product missing in the freezing unit 4.

It should be specifically pointed out that the product dropping in the hopper is gradually taken out off the trays 8 from lower anchorage points to upper anchorage points in order that the pouches containing the product 10, when dropping, do not hit the pouches laying on the lower part, the taking out of the product being gradually made from the rows supporting the product and at each of their faces.

Of course, during the time the machine is operating to cook a frozen food, the coin-box does not accept any coin, and it returns the coins to the potential user until the coin-box indicator turns on.

On the lower side of the machine, it has been provided a collecting box 5 to receive the coins introduced into the machine, and it is equipped with the relative safety means.

Lastly, it must be pointed out that the machine can dispose, on its upper side, of luminous alarm devices in case of vandalic acts, and even it can display an advertising slogan emitting sons or phrases inducing the potential consumers to seek certain product from the machine.

It is not considered necessary to extend more this description for an expert in the art to understand the scope of the invention and the advantages derived from it.

The materials, shape, size and arrangement of the elements are, open to variation, provided that it does not imply any alteration to the essence of the invention.

The terms under which this specification has been described should be taken in an ample sense and non limitative.

I claim:

1. A food vending machine in an upright cabinet with selectors on a front side thereof for selecting a food to be dispensed, said vending machine comprising:

a freezer for storing food to be dispensed in pouches with retaining loops, said freezer comprising dispensing hooks for holding said pouches by said retaining loops and for selectively dropping said pouches directly into a first hopper beneath said freezer;

a microwave oven beneath said freezer for cooking the food to be dispensed, said microwave oven having two doors, a first door on a top of said microwave oven for receiving said pouches directly from said first hopper onto a floor of said microwave oven when said first door is opened and a second door on a front side of said microwave oven for dispensing said pouches containing food that has been cooked by said microwave oven;

a pusher in a side of said microwave opposite said second door for pushing said pouches containing cooked food from said microwave through said second door into a second hopper in front of and below said second door for holding said pouches while food therein completes cooking and cools;

a hatch in a front surface of an exterior of the cabinet for allowing a user to withdraw said pouches containing cooked food from said second hopper when said hatch is unlocked, said hatch having retractable pins for controllably locking and unlocking said hatch;

two displays on the front of the cabinet, a first display for indicating that said hatch is unlocked, and a second display for indicating a state of readiness of the food to be dispensed; and a computer for controlling operation of said dispensing hooks, said microwave oven, said pusher, said retractable pins, and said two displays responsive to a selection of the food to be dispensed, said computer providing instructions for timing operation of said microwave oven and for unlocking said hatch which are specific for the selected food.

2. The vending machine of claim 1 further comprising plural vertical trays in said freezer, each of said trays having a plurality of said dispensing hooks thereon, and wherein said first hopper underlies said plural vertical trays so as to receive said pouches when dropped from said dispensing hooks.

3. The vending machine of claim 2 wherein said dispensing hooks comprise electrically resistive elements which melt said retaining loops to drop said pouches containing the food to be dispensed into said first hopper when said resistive elements are heated.

4. The vending machine of claim 3 wherein said first door of said microwave slides open generally parallel to said floor of said microwave oven to allow said pouches from said first hopper to fall directly onto said floor of said microwave oven.

5. The vending machine of claim 1 wherein said first display is immediately adjacent said hatch and said second display is immediately adjacent the selectors.

* * * * *